United States Patent [19]

Kligerman

[11] Patent Number: 4,886,160

[45] Date of Patent: Dec. 12, 1989

[54] CARTON FOR CONTAINING A PLURALITY OF ITEMS FOR TRANSPORT, STORAGE AND DISPLAY

[76] Inventor: Alan E. Kligerman, c/o Lactaid Inc., Fire Rd. & Lister La. P.O. Box 11, Pleasantville, N.J. 08232

[21] Appl. No.: 267,668

[22] Filed: Nov. 7, 1988

[51] Int. Cl.[4] ..... B65D 5/54

[52] U.S. Cl. ..... 206/44 R; 206/627

[58] Field of Search ..... 206/44 R, 608, 611, 206/45.12, 45.25, 45.23, 45.15, 45.17, 627

[56] References Cited

U.S. PATENT DOCUMENTS

| | | | |
|---|---|---|---|
| 2,180,691 | 11/1939 | Olivier | 206/44 R |
| 3,066,843 | 12/1962 | Johnson | 206/45.17 |
| 3,219,181 | 11/1965 | Dahm | 206/45.29 |
| 3,669,251 | 6/1972 | Phillips, Jr. | 206/44 R |
| 3,687,278 | 8/1972 | Graham et al. | 206/44 R |
| 4,512,477 | 4/1985 | Densen | 229/122 |
| 4,553,666 | 11/1985 | Gullikson | 206/44 R |
| 4,811,837 | 3/1989 | Larizza | 206/44 R |

FOREIGN PATENT DOCUMENTS

| | | | |
|---|---|---|---|
| 0256890 | 1/1928 | Italy | 206/45.29 |
| 0044417 | 6/1938 | Netherlands | 206/611 |
| 2027413 | 2/1980 | United Kingdom | 206/45.12 |

*Primary Examiner*—Jimmy G. Foster
*Assistant Examiner*—David Jenny
*Attorney, Agent, or Firm*—Panitch Schwarze Jacobs & Nadel

[57] ABSTRACT

A carton formed from a unitary blank, wherein the carton is used for shipping and displaying purposes. When shipping, products are positioned within the carton in a manner in which the available space within the carton is utilized efficiently. When the carton is ready to be placed in a display mode, an upper portion of the carton folds forward to allow products which are positioned within the carton in a non-displayable manner to be placed thereon for display purposes.

10 Claims, 3 Drawing Sheets

CARTON FOR CONTAINING A PLURALITY OF ITEMS FOR TRANSPORT, STORAGE AND DISPLAY

FIELD OF THE INVENTION

This invention relates to folding cartons and blanks therefor, and more particularly to cartons for containing a plurality of items for transport, storage and display.

BACKGROUND OF THE INVENTION

The traditional method for shipping products is to position the products within the shipping carton as close as possible with respect to each other. Therefore, when the products arrive at a retail outlet, they can be unpacked and displayed directly on a shelf, without a display unit. However, the problem associated with this method is that the product is not marketed to the fullest extent, since there is no display carton.

In the packaging field, there exists a need for shipping and displaying products inexpensively in a single carton to increase their marketability. One known method requires the products to be positioned and located within the carton for shipping in the exact position in which they are to be displayed. The folding carton includes the use of perforations so as to allow a portion of the carton to be removed. Therefore, once the carton is placed on a display shelf, the detachable portion of the folding carton may be removed so as to display the products therein and to allow customers easy access.

The problems associated with conventional folding shipping and display cartons is that their transaction costs are extremely high, since they are not an efficient mode for shipping products. Specifically, since the products are required to be located within the shipping carton in a displayable position, the products may not be stacked such that all space within the shipping carton is efficiently utilized. Depending upon the geometrical shape of the product, there may be considerable unused space within the shipping carton. Therefore, the costs for shipping the product to a specific location, which is generally based upon size (cubic feet) rather than merely weight, is greatly increased as there is an increase in the required number of cartons to ship a specific amount of product, and consequently, an increase in the shipping space required for moving a specific number of products to a desired location.

The present invention provides a carton formed from a unitary blank, wherein the carton is used for both shipping and displaying purposes. The products are positioned within the shipping carton in a manner in which available space within the carton is utilized efficiently. When the carton is ready to be placed in the display mode, an upper portion of the carton is detached and the remaining front panel of the carton folds forward to allow those products which are positioned within the carton in a non-displayable manner to be placed thereon for display purposes.

SUMMARY OF THE INVENTION

Briefly stated, the present invention comprises a carton formed from a unitary blank for containing a plurality of discrete items for transport, storage and display of the items. The carton comprises a parallelogram-shaped back panel having a predetermined height and width. The carton has a pair of side panels having substantially the same height as the back panel positioned perpendicular to and connected to the back panel and extending a predetermined length from the back panel. A front panel having substantially the same size as the back panel is positioned parallel thereto and spaced therefrom at the predetermined length and extending between and connected to each of the pair of side panels. The panels each include a bottom tab interlocked with at least one other of the bottom tabs to form a base. A first separation means is provided for detaching an upper portion of each of the panels and a second separation means is provided for separating the front panel from the side panels so that the front panel can be pivoted into the same planar position as the base, whereby the items within the carton may be displayed thereon.

BRIEF DESCRIPTION OF THE DRAWINGS

The foregoing summary, as well as the following detailed description, will be better understood when read in conjunction with the appended drawings. For the purpose of illustrating the invention, embodiments which are presently preferred are shown in the drawings. It is understood, however, that this invention is not limited to the precise arrangements and instrumentalities shown.

In the drawings.

DESCRIPTION OF PREFERRED EMBODIMENT

Figure 2:
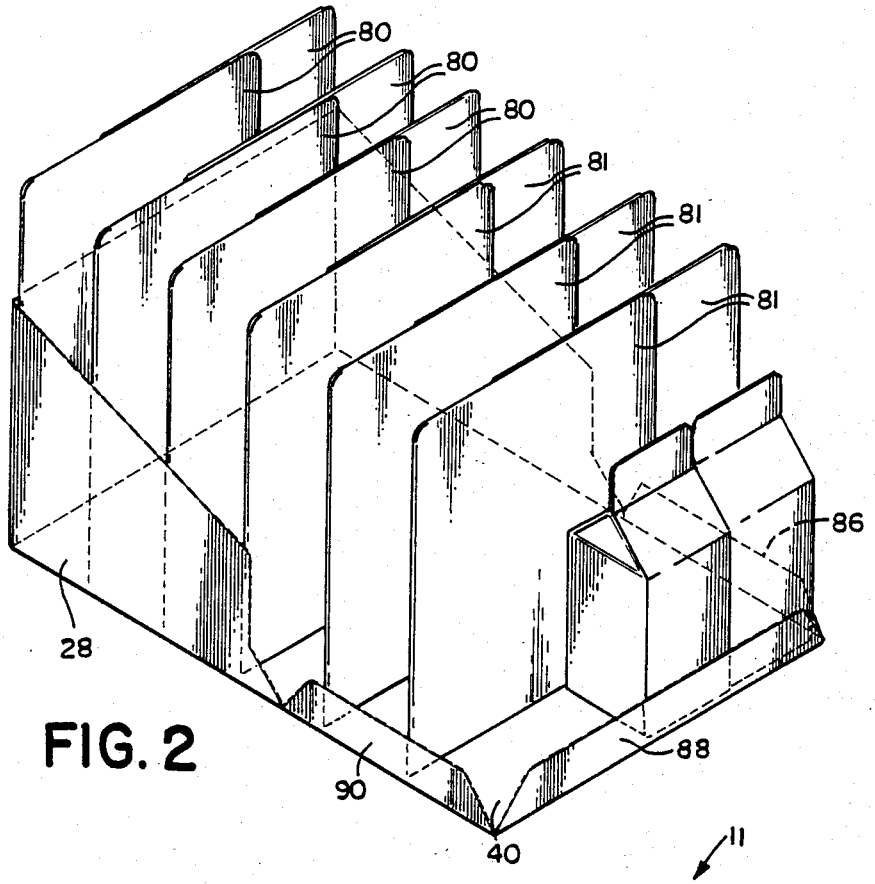
FIG. 2 is a perspective view of the foldable carton of the present invention in the display mode.
Figure 1:
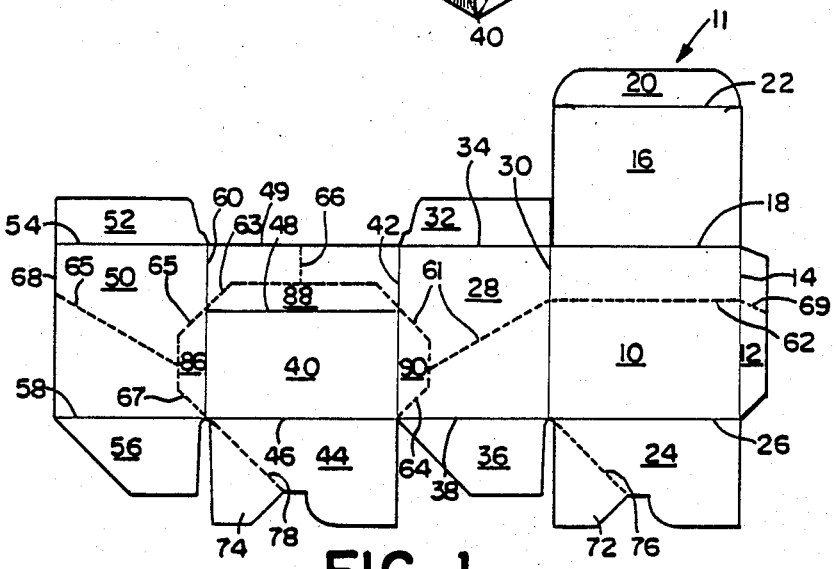
FIG. 1 is a top plan view of a blank for forming a shipping and display carton in accordance with the present invention.
Figure 5:
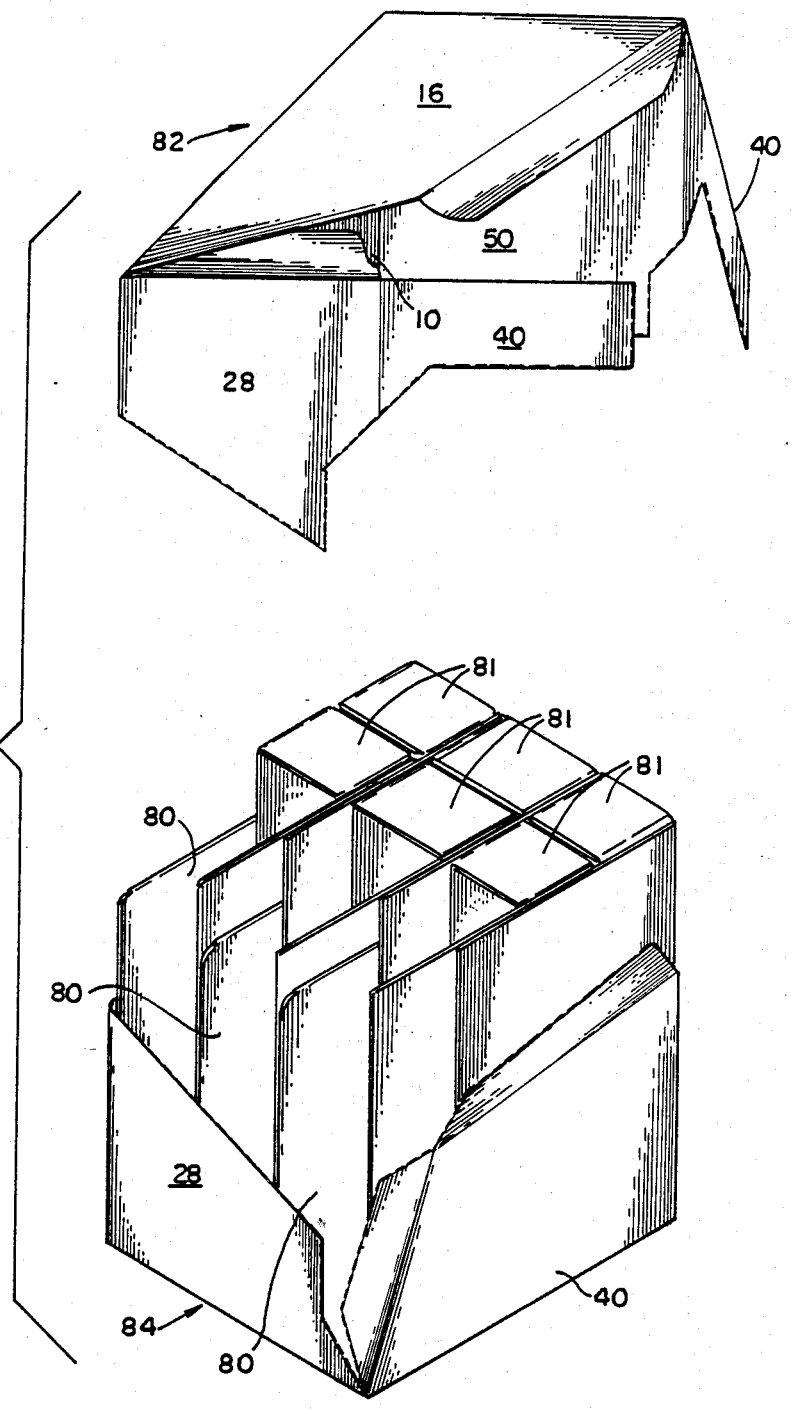
FIG. 5 is an exploded view showing a detachable portion of the foldable carton of FIG. 2 positioned above the display portion of the carton.

Referring to the drawings in detail, wherein like numerals indicate like elements throughout, there is shown in FIGS. 1, 2 and 5 a first preferred embodiment of a carton in accordance with the present invention shown in both blank and assembled forms.

FIG. 1 illustrates a one-piece blank 11 which is used to form a carton for containing a plurality of discrete items for transport, storage and display of the items. The blank 11, which may be made of a generally continuous sheet of paperboard, cardboard, plastic or any other suitable material, includes a back wall panel 10. The back wall panel 10 is generally parallelogram-shaped or square having a predetermined height and width which will vary, depending upon the desired size of the carton. While in the present embodiment the back wall panel 10 is shown as being generally square, it could be rectangular, depending upon the desired shape of the carton and/or the size and number of items to be contained therein. The back wall panel includes a top edge defined by score line 18, a bottom edge defined by score line 26, and a pair of side edges defined by score lines 14 and 30. A linear perforation 62 extends between score lines 30 and 14. In the presently preferred embodiment, the perforation 62 is generally parallel to score line 18 and approximately one-third of the distance between the top and bottom edges of the back wall panel 10. However, the exact orientation and location of perforation 62 may vary.

A generally parallelogram-shaped lid 16, having a width corresponding to the width of back panel 10, includes a front edge defined by score line 22 and a back edge defined by score line 18. The lid 16 is hingedly connected to the back panel 10 at score line 18, for closing and opening the carton. A closing flap 20 is hingedly connected to the front edge of the lid 16, as defined by score line 22.

A bottom tab 24 is hingedly connected to the bottom edge of the back panel 10, along score line 26. A securing flap 12, in the preferred embodiment, is hingedly connected to one side of the back wall panel 10 along score line 14. A linear perforation 69 extends across the securing flap 12. It is within the scope of the invention to place the securing flap 12 along any of the edges of the vertical panels, described hereinafter.

A generally parallelogram-shaped first side panel 28, having substantially the same height as the back wall panel 10, includes a rear edge hingedly connected to back wall panel 10, as defined by score line 30. The first side panel 28 also includes a top edge defined by score line 34, a bottom edge defined by score line 38 and a front edge defined by score line 42. In the embodiment shown in FIG. 1, the first side panel 28 is generally rectangular but it should be understood that it may be square or some other shape and/or the distance between score lines 30 and 42 may vary. A first side flap 32 is hingedly connected to the top edge of the first side panel 28, along score line 34. A second bottom tab 36 is hingedly connected to the bottom edge of the first side panel 28, along score line 38. A perforation 61 extends between score lines 42 and 30 and is interconnected to perforation 62. The first side panel 28 also includes a second perforation 64 extending from perforation 61 to the intersection of score lines 38 and 42.

The blank 11 further includes a generally parallelogram-shaped front wall panel 40 being substantially the same size as back wall panel 10. The front wall panel 40 includes a side edge hingedly connected to first side panel 28, as defined by score line 42. The front panel 40 further includes another side edge defined by score line 60. A score line 48 extends horizontally between score lines 42 and 60. In addition, a perforation 63 positioned above score line 48 extends between score lines 60 and 42 and is interconnected with the perforation 61 of first side panel 2S The front panel 40 has a second perforation 66 extending perpendicularly between perforation 63 and the top edge 49 of front panel 40. A third bottom tab 44 is hingedly connected to the bottom edge of the front panel along score line 46.

The blank 11 further includes a second side panel 50 having substantially the same height as the back wall panel 10 and being substantially the same size as said first side panel 28. A second side flap 52 is hingedly connected to a top edge of the second side panel 50 along score line 54. A fourth bottom tab 56 is hingedly connected to a bottom edge of the second side panel 50 along score line 58. The second side panel 50 includes a front edge hingedly connected to the front panel 40 along score line 60. A rear edge 68 of the second side panel 50 is glued or otherwise attached to the securing flap 12, when the carton is assembled. A perforation 65 extends between the rear edge 68 and score line 60 and interconnects with the perforation 63 of the front wall panel 40. The second side panel 50 also includes a second perforation 67 extending from the perforation 65 to the intersection of score lines 46, 58 and 60.

Figure 4:
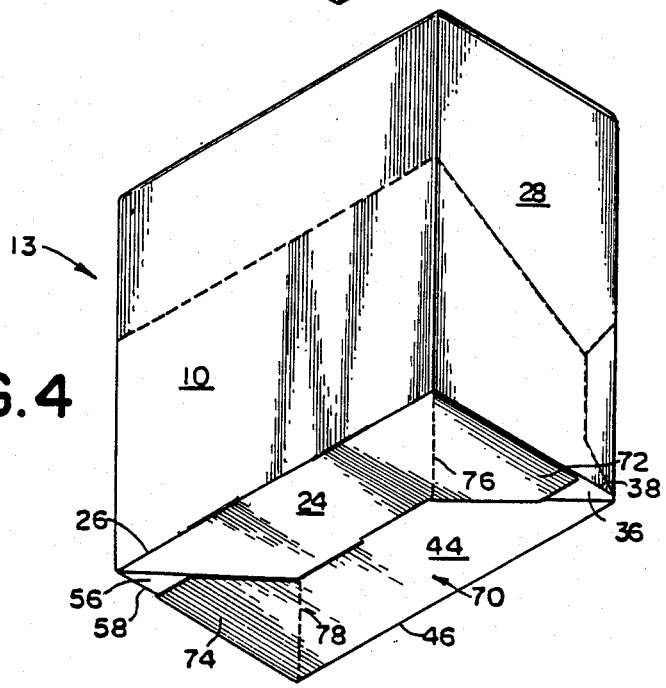
FIG. 4 is a bottom perspective view of a slightly different sized foldable carton in accordance with the present invention in the shipping mode.

To form the carton 13, as shown in FIG. 4, the back wall panel 10 is folded along score line 30, to a position perpendicular to the first side panel 28. The front wall panel 40 is folded along score line 42 to a position perpendicular to the first side panel 28 and parallel to the folded position of the back wall panel 10. The second side wall panel 50 is folded along score line 60 to a position perpendicular to the front wall panel 40 and parallel to the first side panel 28. Thus, the rear edge 68 of the second side panel 50 is positioned adjacent score line 14 of the back wall panel 10. The securing flap 12 is folded along score line 14 to a position perpendicular to the back wall panel 10. In the preferred embodiment, the securing flap 12 is positioned within the carton for cosmetic purposes and is attached proximate the rear edge 68 of the second side panel 50 with liquid glue formed from a chemical solvent mixture. However, it will be appreciated by those skilled in the art that other means may be used for joining the securing flap 12 to the second side panel 50.

Each of the bottom tabs 24, 36, 44 and 56 is folded upwardly toward the geometric center of the partially assembled carton 13 along score lines 6, 38, 46 and 58, respectively. Each of the bottom tabs 24, 36, 44 and 56 is interlocked with at least one other of the bottom tabs in an overlapping and underlying relationship to form a base 70 similar to that shown in FIG. 4. Specifically, when the bottom tabs are interlocked with each other, the bottom tab 24 partially overlaps the second bottom tab 36, which partially overlaps the third bottom tab 44, which partially overlaps the fourth bottom tab 56, which, in turn, partially overlaps the first bottom tab 24. To secure the bottom tabs in an interlocked position, the first and third bottom tabs 24 and 44 include a foldable flap 72 and 74, respectively. Each of the flaps 72 and 74 is foldable along the perforated lines 76 and 78, respectively. Upon the bottom tabs being placed in an interlocked position, the flaps 72 and 74 may be folded away from the base of the box to allow the application of a suitable liquid glue to the tabs 36 and 56. Upon application of the glue, the folding tabs 72 and 74 are then repositioned in the same plane as the remaining bottom tabs and are secured there by the glue or other suitable attaching means. By interweaving the bottom tabs 24, 36, 44 and 58 as described above, a strong base is formed which can withstand large transverse forces. It will be understood that the bottom tabs may be of any other shape or may be interlocked in any other manner, without departing from the scope and spirit of the invention. In addition, it is also within the scope of the invention to replace the bottom tabs 24, 36, 44 and 56 with a single large folding bottom panel similar to lid 16.

To complete the carton 13, first side flap 32 is folded inwardly along score line 34 and the second side flap 52 is folded inwardly along score line 54. Next, the closing flap 20 is folded inwardly along score line 22 and the lid 16 is folded inwardly along score line 18 to a position which is parallel to the base 70 so as to close the carton.

Referring now to FIG. 5, in use, the carton is formed from the blank 11, as described above. In the illustrated embodiment, the products 80 and 81 are positioned within the carton 13 in a fashion which is conducive to shipping the largest quantity of products given the available shipping space within the carton. Specifically, the products 80 are positioned within the carton for shipping, in a displayable manner, while the products 81 are invertably positioned above the products 80 for shipping purposes. Alternatively, the products may be positioned in the desired relationship and the carton is thereafter formed around the products. The carton is then shipped to the desired destination. When the products 80 and 81 within the carton 13 are ready to be displayed, upper portion 82 of carton 13 is detached from lower portion 84 of carton 13 to expose the products therein. In order to detach the upper portion 82, lid 16 is pivoted away from the closed position to an open position. The upper portion 82 can then be readily separated from lower portion 84 along perforations 61, 62, 63, 65 and 69. In the preferred embodiment, once the lid 16 is pivoted to the open position, the user may begin the separation process by starting with perforation 66 in front wall panel 40. This allows easy access to the remaining perforations 61, 62, 63, 65 and 69 so that upper portion 62 can be readily detached, as illustrated in FIG. 5.

Once the upper portion 82 is detached, perforations 64 and 67 allow the remaining portion of front wall panel 40 to be detached from the first side wall panel 28 and the second side wall panel 50. The front wall panel 40 is then pivoted away from the carton 13 along score line 46 to the same planar position as base 70. The flaps 86, 88 and 90 are then folded upwardly along score lines 60, 48 and 42, respectively, to a position perpendicular to front wall panel 40, as illustrated in FIG. 2.

Since the front wall panel 40 is placed in the same plane as base 70, the products 81 which have been invertably positioned within the carton for shipping purposes only (i.e., in a position which is not suitable for display purposes) can then be removed from carton 13 and placed on the front wall panel 40 in a position which maximizes the merchandising of the product. The flaps 86, 88 and 90 are used to retain the products 81 within the display area and may contain decorative and/or informative markings. Since the products 80 and 81 are maintained within the lower portion 84 for display purposes, the exterior thereof can be printed with information and decorative markings so as to enhance the marketability of the products therein.

Figure 3:
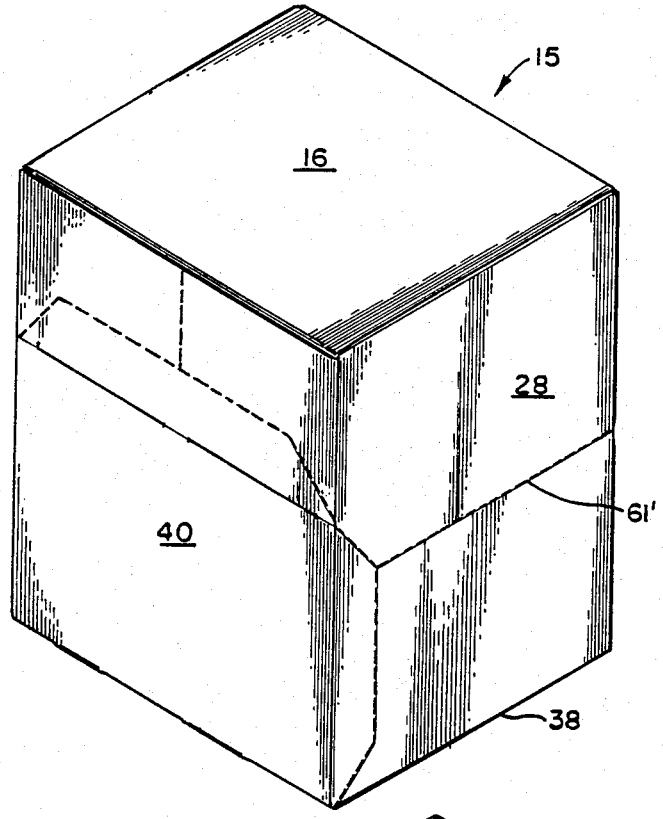
FIG. 3 is a top perspective view of an alternate embodiment of the foldable carton of the present invention in the shipping mode.

Referring now to the alternative embodiment of FIG. 3, a carton 15 similar to that discussed above is shown. Carton 15 includes a perforation 61, which extends generally parallel to score line 38 and approximately half of the distance between the top and bottom edges of the first side panel 28'.

FIG. 4 shows an alternative embodiment of the present invention. A carton 13, formed from a blank similar to that shown in FIG. 1, has a size that is smaller than the carton 15 of FIG. 3. Specifically, the side panel 28; which is shaped generally rectangularly has a smaller width.

While the perforations of the preferred and alternate embodiments have been shown and described in detail, it is recognized that it is within the spirit and scope of the invention to use perforations of different geometrical configurations. For instance, the back panel 10 could have a semi-circular perforated configuration.

The folding carton and blank therefor described herein provide a carton which is used for shipping and display purposes. The products are positioned within the shipping carton in a manner in which the available space within the carton is utilized efficiently, while an upper portion of the carton is detached and the front panel of the carton folds forward to allow those products which are positioned within the carton in a non-displayable manner to be placed thereon for display. It will be recognized by those skilled in the art that changes may be made to the above-described embodiment of the invention without departing from the broad inventive concept thereof. It is understood, therefore, that this invention is not limited to the particular embodiment disclosed, but is intended to cover all modifications which are within the scope and spirit of the invention as defined by the appended claims.

I claim:

1. A unitary blank for forming a carton for containing a plurality of discrete items for transport, storage and display of the items, the blank when assembled having a cover portion detachable from a display portion, said blank comprising:

a back wall panel having a top edge, a bottom edge, a pair of side edges, and a perforation extending between said pair of side edges;

a lid including a front edge and a back edge hingedly connected to said back wall panel top edge;

a first bottom tab hingedly connected to said bottom edge of said back wall panel;

a first side panel having a front edge, a top edge, a bottom edge and a rear edge hingedly connected to one of said pair of side edges of said back wall panel, said first side panel including a perforation extending between said front edge and said rear edge thereof and being interconnected to said back wall panel perforation;

a second bottom tab hingedly connected to said bottom edge of said first side panel;

a front wall panel having a top edge, a bottom edge, a first side edge and a second side edge hingedly connected to said front edge of said first side panel, said front wall panel including a perforation extending between said first side edge and said second edge thereof and being interconnected to said first side panel perforation;

a third bottom tab hingedly connected to said bottom edge of said front wall panel;

a second side panel having a top edge, a bottom edge, a rear edge and a front edge hingedly connected to said first side edge of said front wall panel, said second side panel including a perforation extending between said rear edge and said front edge thereof and being interconnected with said front wall panel perforation, said perforation of said second side panel includes a second perforation extending therefrom to the intersection of said second side panel bottom and front edges and said bottom edge of said front panel;

a fourth bottom tab hingedly connected to said bottom edge of said second side panel; and a securing flap hingedly connected to either said back wall panel or said second side panel and including a perforation.

2. The unitary carton blank as recited in claim 1 wherein said perforation of said first side panel includes a second perforation extending therefrom to the intersection of said first side panel bottom and front edges and said bottom edge of said front panel.

3. The unitary blank as recited in claim 2 further including a closing flap hingedly connected to said front edge of said lid.

4. The unitary blank as recited in claim 3 further including a first side flap hingedly connected to said top edge of said first side panel and a second side flap hingedly connected to said top edge of said second side panel.

5. The unitary blank as recited in claim 1 further including a closing flap hingedly connected to said front edge of said lid.

6. The unitary blank as recited in claim 1 further including a first side flap hingedly connected to said top edge of said first side panel and a second side flap hingedly connected to said top edge of said second side panel.

7. A carton formed from a unitary carton blank for containing a plurality of discrete items for transport, storage and display of the items, said carton comprising:

a parallelogram shaped back panel having a predetermined height and width;

a pair of side panels having substantially the same height as said back panel and being positioned perpendicular to and connected to said back panel and extending a predetermined length from said back panel;

a front panel substantially the same size as said back panel, positioned parallel thereto and spaced therefrom at said predetermined length and extending between and connected to each of said pair of side panels;

each of said panels including a bottom tab interlocked with at least one other of said bottom tabs to form a base;

a first separation means for detaching an upper portion of each of said panels; and a second separation means for separating said front panel away from said side panels so that said front panel can be pivoted into the same planar position as said base whereby the items within said carton may be displayed thereon.

8. The carton as recited in claim 7 wherein said first separation means comprises a first perforation extending along each of said panels and extending generally continuously around the periphery of said carton in an endless loop to define said upper portion.

9. The carton as recited in claim 8 wherein said second separation means comprises a pair of perforations extending between said first perforation on each of said side panels and the point where said side panels, said front panel and said base intersect.

10. The carton as recited in claim 7 further including a lid hingedly connected to said back panel, said lid being engageable with said side panels and said front panel for closing and opening said carton.

* * * * *